US005621509A

United States Patent [19]

Karashima et al.

[11] Patent Number: 5,621,509

[45] Date of Patent: Apr. 15, 1997

[54] APPARATUS AND METHOD FOR CLEANING A TRANSFER DEVICE OF AN IMAGE FORMING APPARATUS

[75] Inventors: Kenji Karashima; Hisashi Fuzisaki, both of Kawasaki, Japan

[73] Assignee: Ricoh Company, Ltd., Tokyo, Japan

[21] Appl. No.: 601,164

[22] Filed: Feb. 13, 1996

[30] Foreign Application Priority Data

Mar. 31, 1995 [JP] Japan ..... 7-076634
Jan. 12, 1996 [JP] Japan ..... 8-003620

[51] Int. Cl.[6] ..... G03G 15/16; G03G 21/00

[52] U.S. Cl. ..... 399/46; 399/50; 399/66; 399/37

[58] Field of Search ..... 355/271, 274, 355/296, 219

[56] References Cited

U.S. PATENT DOCUMENTS 4,183,655 1/1980 Umahashi et al. ..... 355/274
5,337,127 8/1994 Imaue ..... 355/271
5,420,668 5/1995 Okano ..... 355/271 X

FOREIGN PATENT DOCUMENTS 3-267673 11/1991 Japan .
5-11526 1/1993 Japan .
5-11647 1/1993 Japan .
5-27605 2/1993 Japan ..... 355/274
5-181372 7/1993 Japan ..... 355/274
5-341671 12/1993 Japan .
6-266250 9/1994 Japan .

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

A contact type image transferring system and method incorporated in an image forming apparatus for cleaning residual toner on a transfer roller. The transfer roller is in contact with a photoconductive drum and forms a nip between the roller and the drum. A sheet of paper passes through the nip and a toner image on the drum is transferred to the sheet of paper at the nip. When the sheet of paper is not at the nip, a first transfer voltage is applied to the transfer roller for 3 to 20 seconds after a paper feed jam is corrected. The polarity of the voltage causes the toner on the transfer roller to be removed. Then a second transfer voltage is applied to the transfer roller which has a polarity which is opposite to the polarity of the first transfer voltage. The voltage difference between the transfer roller and photoconductive drum may be formed by applying bias voltages to both the photoconductive drum and the transfer roller.

20 Claims, 4 Drawing Sheets

APPARATUS AND METHOD FOR CLEANING A TRANSFER DEVICE OF AN IMAGE FORMING APPARATUS

BACKGROUND OF THE INVENTION

1. Field of the Invention

The present invention relates to an image transferring device for an image forming apparatus such as a copier, printer, facsimile transceiver or similar photographic image forming apparatus in which an image is formed on a photoconductive element. More particularly, the invention is concerned with a contact type image transferring device including, for example, a transfer roller or a transfer belt for transferring a toner image from the photoconductive element to a sheet of paper which is passed through a nip between the photoconductive element and the image transferring device. The present invention further relates to a method and apparatus for electrically cleaning the transferring device.

2. Discussion of the Background

It is a common practice for an image forming apparatus of the type described above to use a contact type image transferring device. The contact type image transferring device such as a transfer roller has applied thereto an electrical field opposite in polarity to the polarity of a toner image on a photoconductive element. The image transferring device transfers the toner image from the photoconductive element to a sheet passed through a nip between the photoconductive element and the transfer device. Since the contact type transfer device is in direct contact with the photoconductive element when the sheet is not at the nip, the toner image on the surface of the photoconductive element transfers to the surface of the transfer device. Subsequently, the toner image on the transfer device is transferred to the back side of the sheet.

Japanese Laid-Open Patent No. 3-69978 discloses a cleaning device for a transfer roller in which toner on the surface of the roller is transferred to the photoconductive element by applying cleaning bias voltage to the transfer roller when the transfer roller is in direct contact with the photoconductive element. Namely, the cleaning bias voltage is applied during a pre-image forming time period (i.e., from the time the photoconductive element starts its rotation until the leading edge of an image area on the photoconductive element reaches the nip), an inter-image forming time period (i.e., between successive copying operations), and a post-image forming time period (i.e., after the last image area on the photoconductive element passes through the nip). Since there is not only regularly charged toner having a positive polarity but also oppositely charged toner having a negative polarity, for cleaning both types of toner, this publication discloses that the polarity of a cleaning bias voltage is switched over between the positive polarity and the negative polarity.

However, in Japanese Laid-Open Patent No. 3-69978, since the cleaning operation is executed every time at the pre-image forming period, the inter-image time, and the post-image forming time, it is always necessary to have a waiting period for the bias cleaning operation.

Further, if a large quantity of toner is adhered to the surface of the transfer roller, the cleaning ability becomes poor since the cleaning time period at the inter-image time is very short and therefore, some toner remains on the transfer roller.

The condition of a large quantity of toner adhering to the surface of the transfer roller occurs when the sheet of paper is jammed. If the sheet of paper is jammed, toner on the surface of the photoconductive element is directly transferred to the transfer roller because the sheet of paper is not fed to the nip and consequently the transfer roller is in direct contact with the photoconductive element. The toner on the transfer roller is then transferred to the back side of the sheet of paper after the jammed sheet of paper is removed and the next image forming operation is started.

Japanese Laid-Open Patent No. 5-341671 discloses a cleaning device for a transfer roller in which after the paper feed jam is corrected, a negative polarity cleaning bias voltage which is the same polarity as the regularly charged toner is applied to the transfer roller for two seconds. Then the cleaning bias voltage is switched over from the negative polarity to the positive polarity and the positive polarity cleaning bias voltage is applied to the transfer roller for two seconds. A timing diagram of the voltage applied to the transfer roller in order to clean the transfer roller is illustrated in FIG. 8. In FIG. 8, time A is the start of the cleaning process, time B is the time at which the voltage is switched in polarity and is two seconds after the cleaning operation starts, and time C is the end of the cleaning operation and is four seconds after the cleaning operation starts.

There is a general trend of reducing the time necessary to perform various operations in photoconductive devices. Therefore if this trend were followed with the teachings related to the cleaning operation performed in JP 5-341671, it would appear to be desirable to reduce the time of cleaning (i.e., reduce the time duration during which the clean bias voltages are applied to the transfer roller).

The present inventors have noticed that when the voltage is changed from the positive polarity to the negative polarity, positively charged toner which has been transferred from the transfer roller to the photoconductive drum may be improperly transferred back to the transfer roller. The inventors have also noticed that when the cleaning voltage is changed from the positive polarity to the negative polarity during the cleaning operation, there may be a voltage spike or overshoot of the desired negative polarity voltage, as illustrated in FIG. 8 at time B. This voltage spike or overshoot causes a very strong attraction of toner on the photoconductive drum which is contacting or is near the transfer roller and results in an undesirable transfer of toner back to the transfer roller. This toner which is transferred back to the transfer roller is then undesirably transferred to the back of the next sheet of paper passing between the photoconductive drum and the transfer roller.

SUMMARY OF THE INVENTION

Accordingly, one object of this invention is to provide a novel image transferring device for an image forming apparatus which can solve the aforementioned drawbacks. A further object of the present invention is to provide an image transferring device for an image forming apparatus in which the cleaning aspect for a contact type transfer device can be improved.

These and other objects are accomplished by a method and system for cleaning a transfer device such as a transfer roller or belt of an image forming device. The image forming device includes an image carrier for carrying a toner image, a charging device which charges the image carrier, the transfer device which contacts the image carrier when a sheet of paper is not at a nip between the image carrier and the transfer device, and a power source which applies voltages to the various elements of the image forming device.

Toner particles, dust, or other material may improperly adhere to the transferring device. This is particularly a problem with toner after a paper jam occurs as toner which is on the image carrier may be directly transferred to the transferring device because there is no paper between the image carrier and the transferring device.

In order to perform optimum cleaning, a first bias voltage is applied for a time period which is between 3 and 20 seconds. Thereafter, the polarity of this voltage is changed and a second bias voltage which is opposite in polarity to the first bias voltage is applied to the transferring device.

The transferring device may be implemented as a transfer roller or transfer belt. The image carrier is charged using a device such as a charging roller, a charging wire, a contacting type blade, or a contacting type brush.

By applying large voltages to the transfer device, the voltages may overshoot the desired voltage for a short period. This overshoot in voltage may cause an improper and undesirable transfer of toner particles. One manner of solving this problem is by applying the first bias voltage for an extended period of time such as from 3 to 20 seconds, or for five rotations of the transfer roller. If overshoot occurs, as the transfer device will be quite clean, the improper transfer of toner back to the transfer device will not be a problem.

As an alternative, in order to reduce the magnitude of the voltage needed as the bias voltage, voltages are applied to both the image carrier and the transfer device in order to create the desired voltage difference between the image carrier and the transfer device. This voltage may be applied to the image carrier when either one of the first and second bias voltages are being applied to the transfer device or while both the first and second bias voltages are being applied to the transfer device.

Other objects and aspects of the present invention will become apparent from the teachings herein.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

First Embodiment

Figure 1:
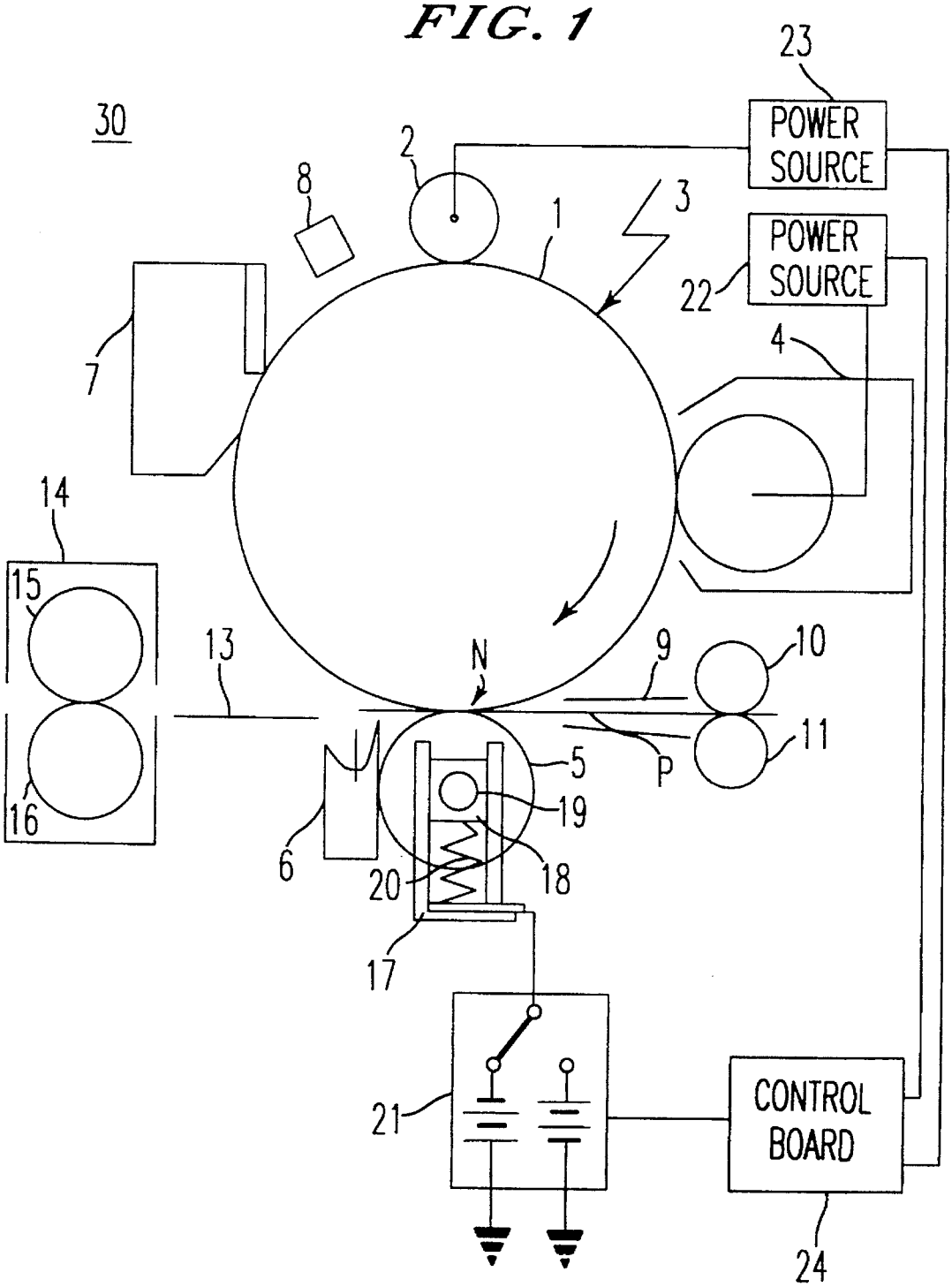
FIG. 1 is a schematic representation showing the general construction of an image forming apparatus embodying the present invention.

Referring now to the drawings, wherein like reference numerals designate identical or corresponding parts throughout the several views, and more particularly to FIG. 1 thereof, an image forming apparatus 30 embodying the present invention is shown. The image forming apparatus 30 has a rotatable photoconductive drum 1 and the following elements which may be conventional and disposed around the drum: a charging roller 2, which charges the photoconductive drum 1, an exposing device 3 which forms a latent image on the photoconductive drum 1, a developing device 4 which develops the latent image and forms a toner image on the photoconductive drum 1, a rotatable transfer roller 5 which rotates by accepting the rotatory force from the photoconductive drum 1 and transfers the toner image to a sheet of paper, a paper separating device 6 including an electrode which separates the sheet of paper after the toner transfer operation is performed, a cleaning device 7 which cleans residual toner on the photoconductive drum 1, and a discharging lamp 8 which discharges an electric charge on the photoconductive drum 1. The photoconductive drum 1 has a diameter of 80 mm and the transfer roller 5 has a diameter of approximately 16 mm to 22 mm, although other sizes can be used, each of which rotates at a speed of 120 mm/sec.

The transfer roller 5 is in pressured contact with the photoconductive drum 1 and forms a nip N between the photoconductive drum 1 and the transfer roller 5. A power source 21 which applies a transfer bias voltage to the transfer roller 5 is connected to the roller 5. A power source 22 applies a developing bias voltage to the developing device 4. A power source 23 applies a charging bias voltage to the charging roller 2. The power sources 21, 22 and 23 are connected to a control board 24. The control board 24 applies control signals to the power sources 21, 22, and 23 in order to control the output timing of the bias voltages, the output voltage values, the polarity of the transfer bias voltage from the power source 21 and so on.

An electrically conductive shaft 19 of the transfer roller 5 is supported on bearings 18 which are made of an electrically conductive resin. The bearings 18 are supported on a conductive spring 20 in a frame 17 which allows the bearings 18 to move up and down. The transfer roller 5 is in pressured contact with the photoconductive drum 1 by means of the spring 20. The amount of force from the transfer roller 5 to the photoconductive drum 1 is less than 9.8N. In this embodiment, a diameter of the transfer roller is 16 mm. Therefore the width of the nip N is between 1.0 mm and 1.5 mm. A transfer bias voltage is applied from the power source 21 to the transfer roller 5 via the electrically conductive spring 20, the electrically conductive bearings 18 and the electrically conductive shaft 19. It is also possible to provide gap rollers (not illustrated) instead of the spring 20 to position the transfer roller 5. In this case, the gap rollers having diameters which are smaller than that of the transfer roller 5, and are fixed on both sides of the shaft 19 and are in contact with a core of the photoconductive drum 1.

This results in a stable pressure from the surface of the transfer roller 5 to the photoconductive drum 1.

The transfer roller 5 includes the electrically conductive shaft 19 and an electrically conductive rubber layer such as silicon rubber, urethane rubber, epichlorohydrin rubber, EPDM or combinations thereof coated on the shaft. The electrically conductive rubber layer has an electric resistance between $10^{10}$ Ω·cm and $5\times10^{11}$10 Ω·cm. The hardness of the rubber is less than 40° (JIS A). Since the electrical resistance of the ends of the roller 5 is smaller than the other portion of the roller 5, unusual discharge from the ends of roller occurs. In order to prevent this unusual discharge, the ends of the roller 5 are tapered. The length of the roller 5 is smaller than that of the photoconductive drum 1.

In operation, the surface of the photoconductive drum 1 is negatively charged to −800 V by the charging device 2. The charged surface of the drum 1 is exposed by the exposing device 3 which include a haloid lamp, and then an electric latent image is formed thereon. The charged surface of the drum 1 where light is not irradiated is developed into a toner image by the developing device 4 in which toner is positively charged and the negative developing bias voltage is applied. The sheet of paper P is fed from a paper tray (not illustrated) to a pair of registration rollers 10 and 11. From the registration rollers 10 and 11, the sheet of paper P is fed to the nip N by the registration rollers 10 and 11 via a pair of paper guide plates 9. The sheet of paper P is in pressured contact between the photoconductive drum 1 by the transfer roller 5 at the nip N. Since a negative bias voltage is applied from the power source 21 to the transfer roller 5, the toner image on the photoconductive drum 1 which is positively charged is transferred to the sheet of paper P. The sheet of paper P is then discharged by a discharge electrode of the paper separating device 6 and then the sheet of paper P is separated from the photoconductive drum 1. The sheet of paper P on which the toner image is formed is then transported to a fixing device 14 which has a heated roller 15 and a pressure roller 16 via a guide plate 13, and the toner image is fixed on the sheet. The sheet of paper P is then discharged to a paper discharge tray (not illustrated). After the transfer operation, residual toner on the surface of the photoconductive drum 1 is cleaned by the cleaning device 7, and residual electric charge on the drum 1 is discharged by the discharge lamp 8.

Figure 2:
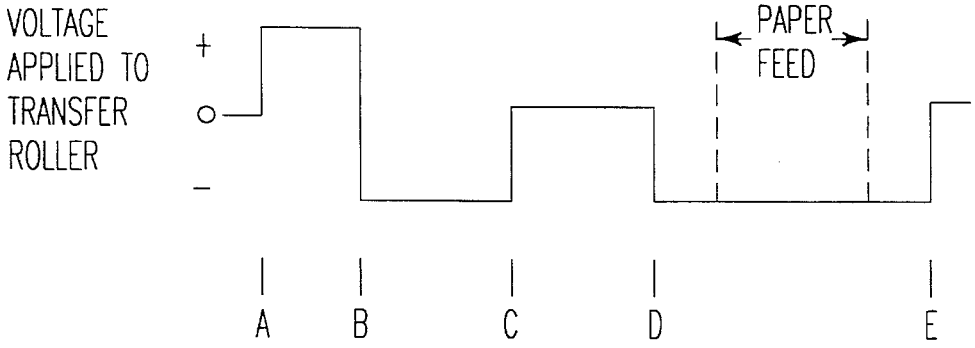
FIG. 2 is a timing diagram showing the transferring bias of a device embodying the present invention.

FIG. 2 shows the timing of applying a cleaning voltage to the transfer roller after a paper jam occurs in order to clean the transfer roller. After the paper jam occurs and is corrected, the cleaning operation for cleaning the transfer roller 5 starts at time A. From time A to time B, a positive bias voltage which has the same polarity as regularly charged (positive polarity) toner is applied to the transfer roller 5. This voltage may be, for example 800 V. The regularly charged toner which is adhered to the transfer roller 5 in a large quantity is transferred from the transfer roller 5 to the photoconductive drum 1. The regularly charged toner which is transferred to the photoconductive drum 1 is cleaned by the cleaning device 7. Then, the polarity of the transfer bias voltage is switched to the negative polarity at time B. The overshoot described in the "Background of the Invention" section will typically occur at time B when the voltage is switched to −1,200 V, for example. The oppositely (negative polarity) charged toner on the transfer roller 5 is transferred to the photoconductive drum 1 and cleaned by the cleaning device 7. The cleaning operation of the transfer roller ends at time C and the next image forming operation begins at time D.

The time duration between the vertical broken lines of FIG. 2 is when a sheet of paper is being fed and is between the photoconductive drum and the transfer roller. During this time period, the toner image is transferred from the photoconductive drum to the sheet of paper using the bias voltage applied to the transfer roller.

During the image forming operation, a negative polarity transfer bias voltage having a polarity which is opposite to that of the regularly charged toner is applied to the transfer roller 5. Before the sheet of paper P reaches the nip, the oppositely charged toner which is adhered to a non-image forming area of the photoconductive drum 1 is not transferred to the transfer roller 5, since the negative polarity transfer bias voltage is applied to the transfer roller 5. Since the cleaning operation for the transfer roller 5 from the time A to C is executed during a preparatory time period, for example the time period for increasing the temperature of a fixing roller which decreased because power to the fixing device was turned off after a paper jam, the waiting time period for the cleaning operation is reduced. The image transfer operation is complete by time E.

Figure 3:
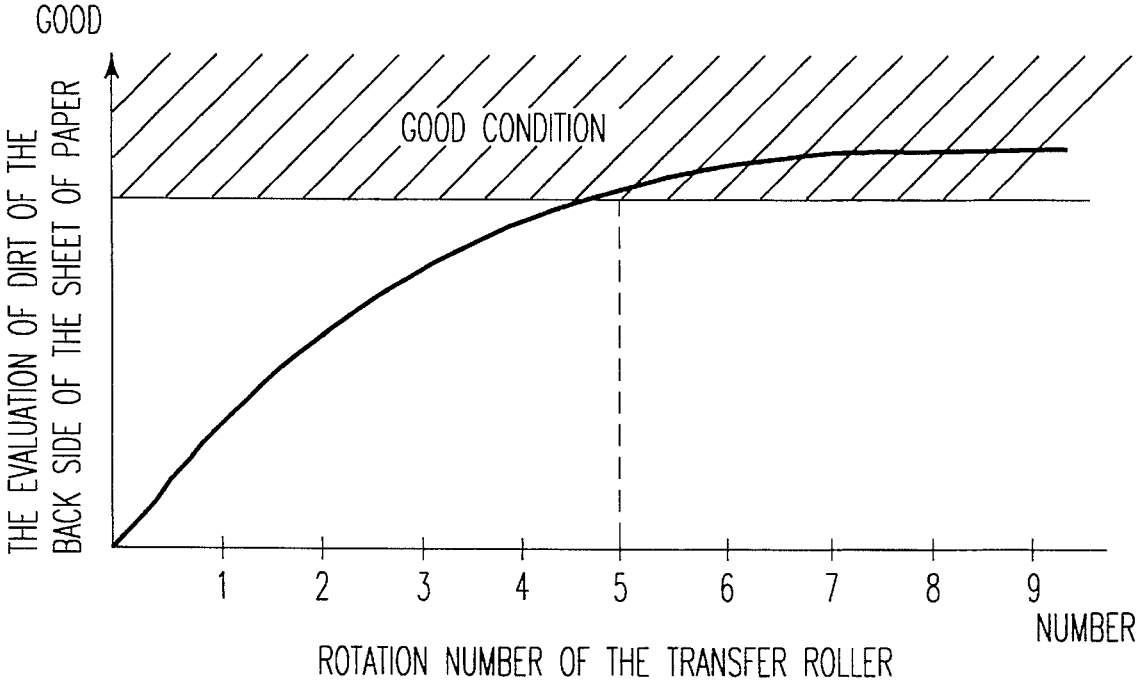
FIG. 3 is a graphical representation showing the cleaning ability of a transfer roller embodying the present invention.

The inventors conducted an experiment to find the optimum cleaning time period which would sufficiently clean the transfer roller so that the back side of a sheet of paper did not become dirty. In this experiment, the positive polarity current was set +5 μA to generate a positive bias voltage, and the negative polarity current to −10 μA. FIG. 3 shows the results of the experiment. The experiment indicated that a proper time period of applying the positive bias current to the transfer roller 5 was from 3 to 20 seconds which corresponds to more than five rotations of the transfer roller 5. A more desirable time period was determined to be from 3 second to 10 seconds. Further, the time period of applying the negative bias current to the transfer roller 5 in order to generate the negative voltage for the transfer roller was from 3 to 20 second which corresponds to more than five rotations of the transfer roller 5. A preferred range is from 3 seconds to 15 seconds. Each of the time periods corresponded to the time period that the toner on the transfer roller 5 is completely or nearly completely transferred to the photoconductive drum 1. Therefore, the problem of overshoot explained does not influence the cleaning ability.

The present invention can be applied to a reverse polarity developing system which develops an exposed area using negative polarity toner. In this case, the polarity of the transfer bias current and voltage is positive during the ordinary transfer operation of toner to the paper. During the cleaning operation, the negative cleaning current and voltage (e.g., −2,000 V) which is the same polarity as the regularly charged toner is first applied to the transfer roller 5, and then the positive cleaning current and voltage (e.g., +1,800 V) which is the same polarity as the oppositely (positively) charged toner is applied. The time period of applying the negative cleaning current and voltage to the transfer roller 5 is from 3 to 20 seconds and more preferably from 3 seconds to 10 seconds. Further, the time period of applying the positive cleaning current and voltage to the transfer roller 5 is from 3 to 20 seconds and, more desirably from 3 seconds to 15 seconds.

Second Embodiment

Figure 4:
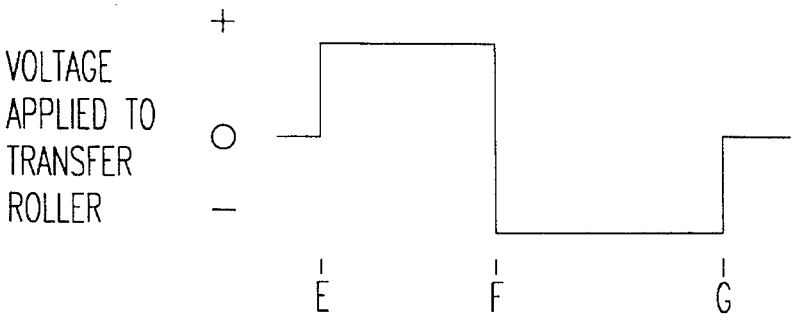
FIG. 4 is a timing diagram showing the transferring bias of a modified embodiment of the present invention in which the cleaning operation is performed after a predetermined number of copies.

FIGS. 4 shows a modified embodiment of this invention Referring to FIG. 4, when a predetermined number of image forming operation is finished at time E, a cleaning operation of the transfer roller 5 starts. During the cleaning operation, a positive cleaning current and voltage which is the same polarity as the polarity of the regularly charged toner is applied to the transfer roller 5 to transfer the regularly charged toner from the transfer roller 5 to the photoconductive drum 1. Then at time F, a negative polarity cleaning current and voltage which is the same polarity as oppositely charged toner is applied to the transfer roller 5 to transfer the oppositely charged toner from the transfer roller 5 to the photoconductive drum 1 until time G. As a result of an experiment, it was determined that an optimum time period for applying each of the cleaning currents was more than 3 seconds. Further, it was determined that if the cleaning operation was executed every 200 to 300 image forming operations, the back side of sheets of paper did not become dirty. The present embodiment is also applicable to the reverse polarity developing system. According to the present embodiment, the waiting time for the cleaning operation is reduced.

Third Embodiment

During the operation of the first and second embodiments, there is no bias voltage or current applied to the photoconductive drum when a bias is applied to the transfer roller. However if the photoconductive drum is charged during the cleaning operation, it is not necessary to switch over the polarity of a transfer cleaning voltage from a positive polarity to a negative polarity and from a negatively charged polarity to a positively charged polarity for negatively charged toner, thus eliminating or reducing the problem of overshoot.

Figure 5:
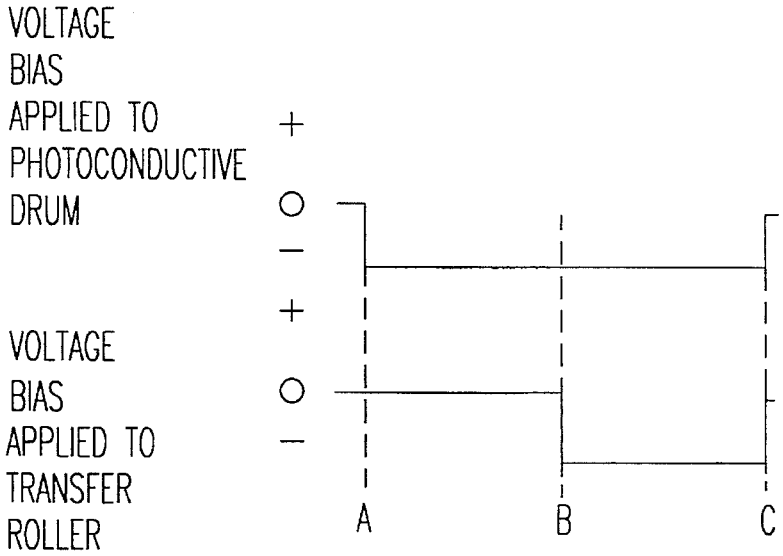
FIG. 5 is a timing diagram showing the voltage of the photoconductive drum and the bias applied to the transfer roller of a modified embodiment of the present invention in which a voltage is applied to the photoconductive drum during the cleaning operation.

FIG. 5 is a timing diagram showing the voltage of the photoconductive drum and the transfer roller during a cleaning operation for the case of the regularly charged developing system. Referring to FIG. 5, the charging roller 2 charges the photoconductive drum 1 to −800 V during the cleaning operation. At the beginning of the cleaning operation, the transfer roller cleaning voltage is 0 V, since the regularly (i.e. positively) charged toner is transferred to the photoconductive drum 1 by the electric potential (−800 V) of the photoconductive drum 1. Then the negative polarity transfer cleaning voltage (−2,000 V) is applied to the transfer roller 5 causing the oppositely (i.e. negatively) charged toner to transfer from the transfer roller 5 to the photoconductive drum 1. In other words, it is not necessary to apply a positive polarity cleaning voltage to the transfer roller 5 during the cleaning operation between times A and B as illustrated in the embodiment of FIG. 2.

According to the present embodiment, it is not necessary to provide a positive voltage power source and a switching circuit for switching over the polarity of the cleaning voltage in the power source 21, and therefore the size of the power source 21 becomes small and costs are reduced. Further, since the difference between the transfer cleaning voltage for the regularly charged toner and for the oppositely charged toner becomes small, the overshoot problem does not occur.

Figure 6:
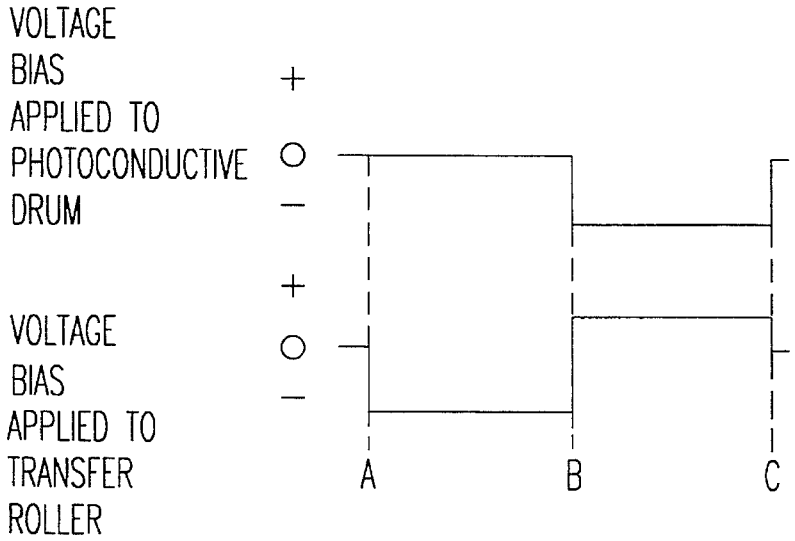
FIG. 6 is a timing diagram showing the voltage of the photoconductive drum and the bias applied to the photoconductive drum of a modified embodiment of the present invention in which the voltages applied to both the photoconductive drum and the transfer roller are changed during the cleaning operation.
Figure 7:
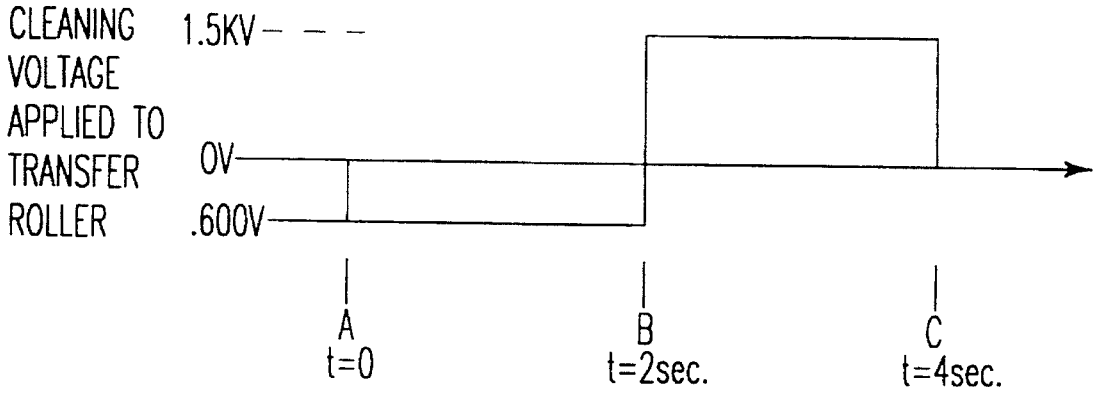
FIG. 7 PRIOR ART
FIG. 7 is a timing diagram showing the voltage applied to transfer roller during a cleaning operation in a prior art device.
Figure 8:
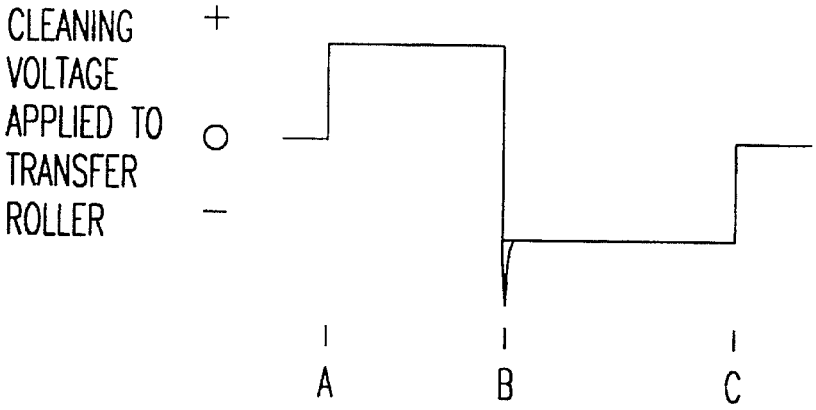
FIG. 8 is a timing diagram illustrating the problem of overshoot during a change-over of the polarity of the cleaning bias which the inventors have discovered.

FIG. 6 is a timing diagram showing the voltage of the photoconductive drum and the transfer roller cleaning voltage in case of a developing system using toner having an opposite charge as compared to the toner corresponding to the example of FIG. 5, (i.e. negatively charged toner is developed on a exposed surface of a photoconductive drum when the photoconductive drum is charged to a negative polarity). Referring to FIG. 6, at the beginning of the cleaning operation at time A, the voltage of the photoconductive drum 1 is 0 V and a negative polarity transfer cleaning voltage (−2,000 V) is applied to the transfer roller 5. In this condition, the regularly (i.e. negatively) charged toner is transferred from the transfer roller 5 to the photoconductive drum 1 by the electric potential between the transfer roller 5 and the photoconductive drum 1.

Next, the charging roller 2 negatively charges the photoconductive drum 1 and the transfer cleaning voltage is switched over from the negative polarity to the positive polarity (+1,000 V) time B. At the same time, the voltage of the photoconductive drum is changed to −800 V. Therefore, the oppositely (i.e. positively) charged toner is transferred from the transfer roller 5 to the photoconductive drum 1.

According to the present embodiment, since the electric potential between the transfer roller 5 and the photoconductive drum 1 for transferring the toner results from opposite polarity voltages being applied to the photoconductive drum 1 and the transfer roller 5, the individual negative and positive polarity voltages applied to photoconductive drum and/or the transfer roller become smaller. Therefore, the pressure-resistance or current and voltage limits of a relay for switching over the polarity of the power source 21 can be reduced, thus reducing costs. Further, since the difference between the transfer cleaning voltage for the regularly charged toner and for the oppositely charged toner is reduced, the overshoot does not occur. Therefore, an influence of the overshoot on the cleaning ability is reduced.

The present invention may utilize a transfer belt as an alternative to the transfer roller. Further, it is also possible to provide a charging wire, a contacting type blade, or a contacting type brush as an alternative to the charging roller. Additionally, the power sources may be implemented using either common or separate power supplies.

The present invention uses control boards to perform the described function. These boards may be implemented using a conventional microprocessor or conventional general purpose digital computer programmed according to the teachings of the present application, as will be appropriate to those skilled in the art. Appropriate software coding can readily be prepared by skilled programmers based on the teachings of the present disclosure, as will be apparent to those skilled in the software art. The invention may also be implemented by the preparation of applications specific integrated circuits or by interconnecting an appropriate network of conventional component circuits, as will be readily apparent to those skilled in the art.

Obviously, numerous modification and variations of the present invention are possible in light of the above teachings. It is therefore to be understood that within the scope of the appended claims, the invention may be practiced otherwise than as specifically described herein.

What is claimed is as new and is desired to be secured by Letters Patent of the United States is:

1. An image forming apparatus, comprising:

an image carrier for carrying a toner image;

a charging device which charges said image carrier;

a transferring device which is in direct contact with said image carrier when a sheet of paper is not at a nip between said image carrier and said transferring device;

a power source which applies a bias voltage to said transferring device; and a control device which controls said power source so as to apply a first bias voltage having a first polarity as said bias voltage to said transferring device for 3 to 20 seconds in order to transfer material having said first polarity from said transferring device to said image carrier, and switching a polarity of said bias voltage and applying a second bias voltage as said bias voltage to said transferring device, said second bias voltage having a second polarity which is opposite to the first polarity in order to transfer material having said second polarity from said transferring device to said image forming device.

2. An apparatus as claimed in claim 1, wherein:

said control device controls said charging device to charge said image carrier when at least one of said first and second bias voltages are being applied to said transferring device during a cleaning operation.

3. An apparatus according to claim 1, wherein:

said charging device is a roller; and said transferring device is a roller.

4. An apparatus according to claim 1, wherein:

said transferring device is a roller; and said control device controls said power source to apply the first bias voltage for at least five rotations of said roller.

5. An apparatus according to claim 1, wherein:

said control device controls said power source to apply said first bias voltage from 3 to 10 seconds.

6. An apparatus according to claim 1, wherein:

said control device controls said power source to apply said second bias voltage from 3 to 20 seconds.

7. An apparatus according to claim 1, wherein said control device controls said power source to apply said first and second bias voltages after a paper jam is corrected.

8. An apparatus according to claim 1, wherein said control device controls said power source to apply said first and second bias voltages after a predetermined number of image forming operations.

9. An image forming apparatus, comprising:

an image carrier for carrying a toner image;

a charging device which charges said image carrier;

a transferring device which is in direct contact with said image carrier when a sheet of paper is not at a nip between said image carrier and said transferring device;

a power source which applies a bias voltage to said transferring device; and a control device which controls said power source so as to apply a first bias voltage having a first polarity as said bias voltage to said transferring device in order to transfer material having said first polarity from said transferring device to said image carrier, switching a polarity of said bias voltage and applying a second bias voltage having a second polarity which is opposite to the first polarity to the transferring device in order to transfer material having said second polarity from said transferring device to said image carrier, and controlling the charging device to charge said image carrier when at least one of said first and second bias voltages are being applied to the transferring device, wherein the control device controls said charging device to charge the image carrier only when one of the first and second bias voltages are being applied to the transferring device.

10. A method of cleaning a transferring device of an image forming apparatus, comprising the steps of:

applying a first bias voltage having a first polarity to the transferring device for 3 to 20 seconds in order to transfer material having said first polarity from said transferring device to an image carrier which contacts the transferring device; and applying a second bias having a second polarity which is opposite to the first polarity in order to transfer material having said second polarity from said transferring device to said image carrier.

11. A method as claimed in claim 10, further comprising the step of:

charging said image carrier when at least one of said first and second bias voltages are being applied to said transferring device during a cleaning operation.

12. A method according to claim 10, wherein:

said steps of applying bias voltages to the transferring device include applying the bias voltages to the transferring device which is a transfer roller.

13. A method according to claim 10, wherein:

said transferring device is a roller; and said step of applying the first bias voltage includes applying the first bias voltage for at least five rotations of said roller.

14. A method according to claim 10, wherein:

said step of applying the first bias voltage applies the first bias voltage from 3 to 10 seconds.

15. A method according to claim 10 wherein:

said step of applying the second bias voltage applies the second bias voltage from 3 to 20 seconds.

16. A method according to claim 10, wherein said steps of applying the first and second bias voltages are performed after a paper jam is corrected.

17. A method according to claim 10 wherein said steps of applying the first and second bias voltages are performed after a predetermined number of image forming operations.

18. A method of cleaning a transferring device of an image forming apparatus, comprising the steps of:

applying a first bias voltage having a first polarity to the transferring device in order to transfer material having said first polarity from said transferring device to an image carrier which contacts the transferring device;

applying a second bias having a second polarity which is opposite to the first polarity in order to transfer material having said second polarity from said transferring device to said image carrier; and charging said image carrier when at least one of said first and second bias voltages are being applied to the transferring device, wherein the step of charging the image carrier is performed only when one of the first and second bias voltage are being applied to the transferring device.

19. An image forming apparatus, comprising:

an image carrier for carrying a toner image;

a charging device which charges said image carrier;

a transferring device which is in direct contact with said image carrier when a sheet of paper is not at a nip between said image carrier and said transferring device;

a power source which applies a bias voltage to said transferring device; and a control device which controls said power source so as to apply a first bias voltage having a first polarity as said bias voltage to said transferring device for more than five rotations of said transferring device in order to transfer material having said first polarity from said transferring device to said image carrier, and switching a polarity of said bias voltage and applying a second bias voltage as said bias voltage to said transferring device, said second bias voltage having a second polarity which is opposite to the first polarity in order to transfer material having said second polarity from said transferring device to said image forming device.

20. A method of cleaning a transferring device of an image forming apparatus, comprising the steps of:

applying a first bias voltage having a first polarity to said transferring device for more than five rotations of said transferring device in order to transfer material having said first polarity from said transferring device to an image carrier which contacts said transferring device; and applying a second bias having a second polarity which is opposite to the first polarity in order to transfer material having said second polarity from said transferring device to said image carrier.

* * * * *